US007414822B2

(12) United States Patent
Hosaka et al.

(10) Patent No.: US 7,414,822 B2
(45) Date of Patent: Aug. 19, 2008

(54) CURRENT CONTROL CIRCUIT

(75) Inventors: Kenichi Hosaka, Ora-Gun (JP); Tadao Mandai, Ora-Gun (JP)

(73) Assignee: Sanyo Electric Co., Ltd., Moriguchi-shi, Osaka (JP)

( * ) Notice: Subject to any disclaimer, the term of this patent is extended or adjusted under 35 U.S.C. 154(b) by 699 days.

(21) Appl. No.: 11/018,826

(22) Filed: Dec. 21, 2004

(65) Prior Publication Data

US 2005/0140314 A1 Jun. 30, 2005

(30) Foreign Application Priority Data

Dec. 25, 2003 (JP) ..... 2003-428562

(51) Int. Cl.
*H01H 47/00* (2006.01)

(52) U.S. Cl. ..... 361/139

(58) Field of Classification Search ..... 361/93.1, 361/139, 143, 159, 268
See application file for complete search history.

(56) References Cited

U.S. PATENT DOCUMENTS 4,841,166 A * 6/1989 Harnden ..... 327/110
5,438,290 A * 8/1995 Tanaka ..... 327/108
5,847,912 A * 12/1998 Smith et al. ..... 361/93.1
5,892,650 A * 4/1999 Kinoshita et al. ..... 361/159
6,822,518 B1 * 11/2004 Lin et al. ..... 330/296
6,856,098 B2 * 2/2005 Piaskowski ..... 315/224
2002/0085402 A1 * 7/2002 Zhang ..... 363/127

FOREIGN PATENT DOCUMENTS

JP 2002-289385 10/2002

OTHER PUBLICATIONS

English Patent Abstract of 2002-289385 from esp@cenet.

* cited by examiner

*Primary Examiner*—Michael J Sherry
*Assistant Examiner*—Christopher J Clark
(74) *Attorney, Agent, or Firm*—Osha Liang LLP

(57) ABSTRACT

A current control circuit controls a current from a current drawing circuit to which a primary coil of a transformer is connected. A first N channel transistor has a source connected to the current drawing terminal and has a body diode that directs a current from the source to a drain. A second N channel transistor has a drain connected to the drain of the first N channel transistor and a source connected to a ground. The second N channel transistor has a body diode that directs a current from the source to the drain. The first and second N channel transistors are turned on to direct a current from the current drawing terminal to the ground via the first and second N channel transistors. The first and second N channel transistors are turned off to stop the current from the current drawing terminal. Further, the body diode of the first N channel transistor inhibits current flowing from the ground to the primary coil of the transformer.

3 Claims, 3 Drawing Sheets

CURRENT CONTROL CIRCUIT

CROSS-REFERENCE TO RELATED APPLICATION(S)

The entire disclosure of Japanese Patent Application No. 2003-428562 including specification, claims, drawings and abstract is incorporated herein by reference.

BACKGROUND OF THE INVENTION

1. Field of the Invention

The present invention relates to a current control circuit that controls a current flowing through a primary coil of a transformer, and in particular to a current control circuit that prevents a reverse current induced by a back electromotive force exerted by the primary coil of the transformer.

2. Related Art

CCFLs (Cold Cathode Fluorescent Lamps) are widely utilized for liquid crystal backlights. As CCFLs must be supplied with an alternating current, typically a primary coil of a transformer is supplied with an alternating current to cause the CCFL connected to a secondary coil to emit light. Accordingly, a circuit is required which supplies an alternating current to the primary coil of the transformer.

An example configuration of such a circuit is a push-pull amplifier as shown in FIG. 3. In this circuit, a P channel transistor Q1 is provided between a power source VDD and an output terminal. A diode SBD and an N channel transistor Q2 are arranged between the output terminal and a ground. The transistor Q1 is turned on, while the transistor Q2 is turned off, to allow a current from the power source VDD to flow out from the output terminal. The transistor Q1 is turned off, while the transistor Q2 is turned on, to allow a current to be drawn from the output terminal.

The primary coil of the transformer is connected to the output terminal, and the CCFL is connected to the secondary coil. Thus, by supplying a predetermined alternating current to the primary coil of the transformer, it is possible to allow the CCFL connected to the secondary coil to emit light. A drive circuit for the CCFL is described in Japanese Patent Laid-Open No. 2002-289385.

In such a circuit as described above, if the transistor Q2 is turned on or off, a relatively high reverse voltage is applied to the diode SBD. On the other hand, when the transformer Q2 is turned on, a relatively large current flows through the circuit. In, for example, a backlight for a liquid crystal display in a portable apparatus or the like, a peak current is often at least 10 A. Thus, a Schottky barrier diode (SBD) is normally employed as the diode SBD. However, as heat or resistance from the diode SBD is disadvantageous, the diode SBD must have a large size. For example, the diode SBD must be of, for example, an SMP (Surface Mount Package) class. This is disadvantageous in terms of space and also disadvantageously increases costs.

SUMMARY OF THE INVENTION

According to the present invention, when the first N channel transistor is turned off, its body diode inhibits a current in the opposite direction. This eliminates any need for a diode for preventing the reverse current. Then, the on resistance of the transistor can be reduced below that of the diode. This prevents heat caused by a large current generated during an on period. Further, the overall size of the circuit can be reduced.

DETAILED DESCRIPTION OF THE PREFERRED EMBODIMENT

A preferred embodiment of the present invention will be described below with reference to the drawings.

Figure 1:
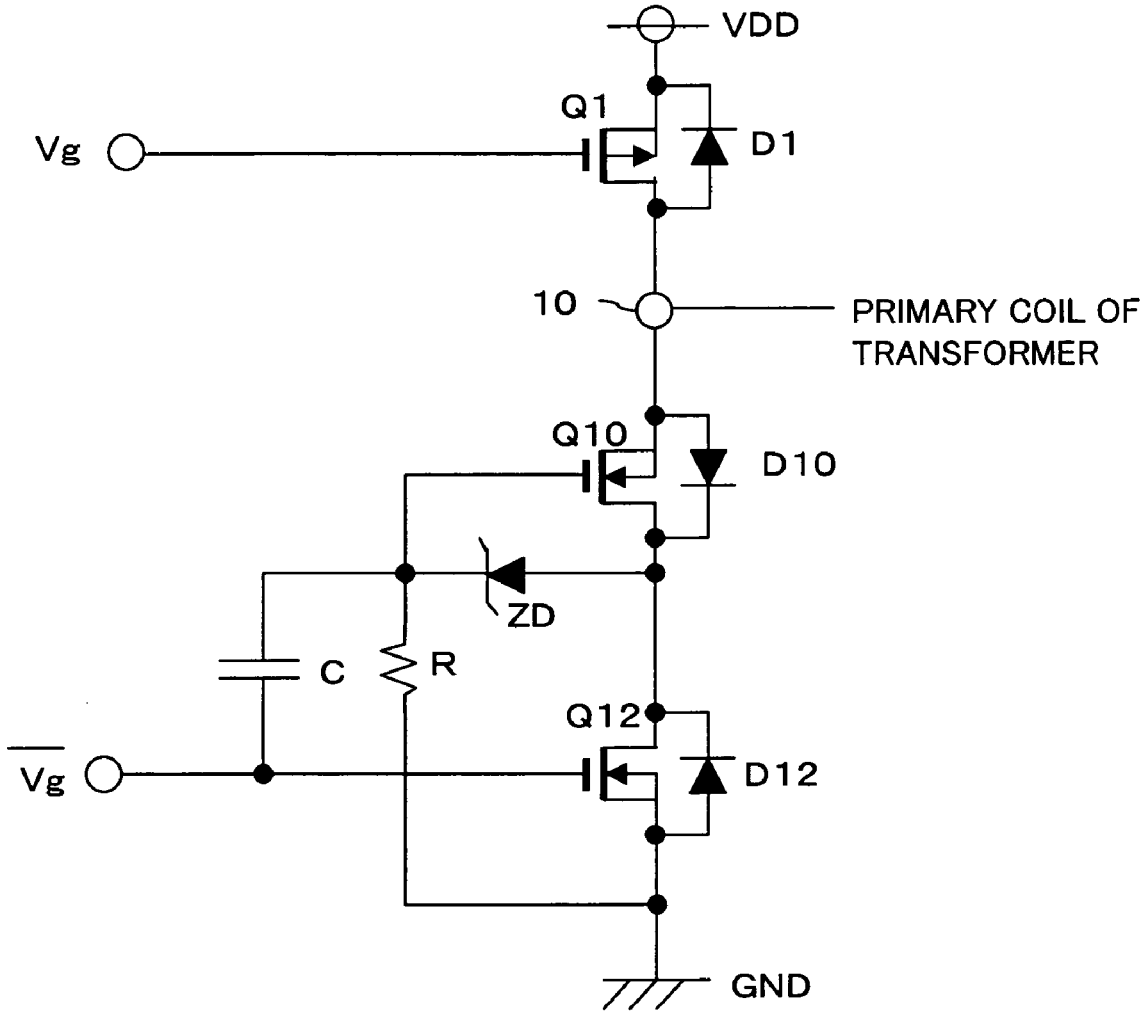
FIG. 1 is a diagram showing an example configuration according to a preferred embodiment of the present invention.

FIG. 1 shows a circuit according to the present embodiment. A source of a P channel transistor Q1 is connected to a power source. A drain of the transistor Q1 is connected to an output terminal (discharge and suction end) 10. Further, a drive signal Vg is supplied to the transistor Q1. Turning on the transistor Q1 causes a current from the power source to be discharged from the output terminal 10. A body diode D1 is formed in the transistor Q1 to direct a current from its drain to source (from the output terminal 10 to the power source).

On the other hand, a source of the first N channel is connected to the output terminal. A drain of a second N channel transistor Q12 is connected to the drain of the first N channel transistor Q10. A source of the second N channel transistor is connected to the ground. Body diodes D10 and D12 are formed in the first and second N channel transistors Q10 and Q12, respectively, to direct a current from their sources to drains.

An anode of a Zener diode ZD is connected to a junction between the drains of the first and second N channel transistors Q10 and Q12. A cathode of the Zener diode is connected to a gate of the first N channel transistor Q10. Further, the gate of the first N channel transistor Q10 connects to one end of a resistor R having the other end connected to the ground and one end of a capacitor C having the other end connected to a gate of the second N channel transistor.

The gate of the second N channel transistor Q12 is supplied with a drive signal (Vg upper bar) of a phase opposite to that of the drive signal Vg supplied to the gate of the transistor Q1.

With this circuit, when the drive signal Vg, which is a rectangular wave, and its reverse signal Vg (upper bar) are input to the gates of the transistor Q1 and second N channel transistor Q12, the transistor Q1 is turned on to discharge a current from the output terminal 10, as described in the above conventional example.

At this time, an L level is input to the gate of the second N channel transistor Q12 to turn off the second N channel transistor Q12. Further, the output terminal 10 has a high voltage (power supply voltage), so that a current flows from the output terminal to the capacitor C via the body diode D10 of the first N channel transistor Q10 and the Zener diode ZD. Therefore, a gate voltage of the first N channel transistor Q10 is equal to the voltage of the output terminal, that is, a power supply voltage. A current flows to the ground via the resistor R. However, there is a large amount of current flowing from the output terminal 10. Accordingly, this amount of current is not problematic.

Then, when the drive signal Vg changes to the L level, the transistor Q1 is turned off. The gate of the second N channel transistor Q12 changes to an H level to turn on the second N channel transistor Q12. Further, the capacitor C serves to make the voltage of the gate of the first N channel transistor Q10 equal to the power supply voltage plus a voltage corresponding to the H level of the input signal Vg (upper bar). The drain of the first N channel transistor Q10 is provided with a ground voltage to turn on the first N channel transistor Q10. Consequently, a current from the output terminal 10 flows to the ground via the first and second N channel transistors Q10 and Q12.

In this manner, a current sucked from the output terminal flows to the ground via the N channel transistor Q10 which is on. On resistance of the N channel transistor Q10 can be sufficiently reduced compared to the diode; the on resistance can be reduced to about 50 mΩ.

The capacitor C can be set at about 200 nF, and the resistor R can be set at about 10 Ω.

In this case, a drain voltage of the first N channel transistor Q10 is equal to the ground voltage, and no charge current flows to the capacitor C. Consequently, the charge voltage of the capacitor C flows to the ground via the resistor R. Therefore, a predetermined time later, before the drive signal Vg changes, the gate voltage of the first N channel transistor Q10 becomes sufficiently close to the ground voltage to turn off the first N channel transistor Q10.

In this manner, the gate voltage of the first N channel transistor Q10 gradually varies to enable relatively soft switching. This makes it possible to reduce, to a relatively small value, a back electromotive force exerted by a primary coil of a transformer connected to the output terminal. Further, turning off of the first N channel transistor Q10 can, in combination with its body diode D10, prevent a reverse current from flowing from the ground to the primary coil of the transformer via the body diode D12 of the second N channel transistor Q12. This eliminates the need for another diode.

Turning off the first N channel transistor Q10 may cause that transistor's source voltage to vibrate. However, the drain voltage of the first N channel transistor Q10 is kept equal to the ground voltage. After the first N channel transistor Q10 has been turned off, the second N channel transistor Q12 remains on. Accordingly, a current can flow from the output terminal to the ground to allow a surplus current in the transformer to be discharged.

In the circuit of the present embodiment, it is possible to mount the first and second N channel transistors Q10 and Q12, the capacitor C, the resistor R, the Zener diode ZD, and the like on a single copper frame, wire the other parts together, and mold the copper frame and the wired parts to create a single package.

This enables the size of the circuit to be reduced, and the reduced on resistance serves to suppress generation of heat. This in turn effectively reduces the part mounting area, the amount of time and labor required for construction, and the total cost of the component.

Figure 2:
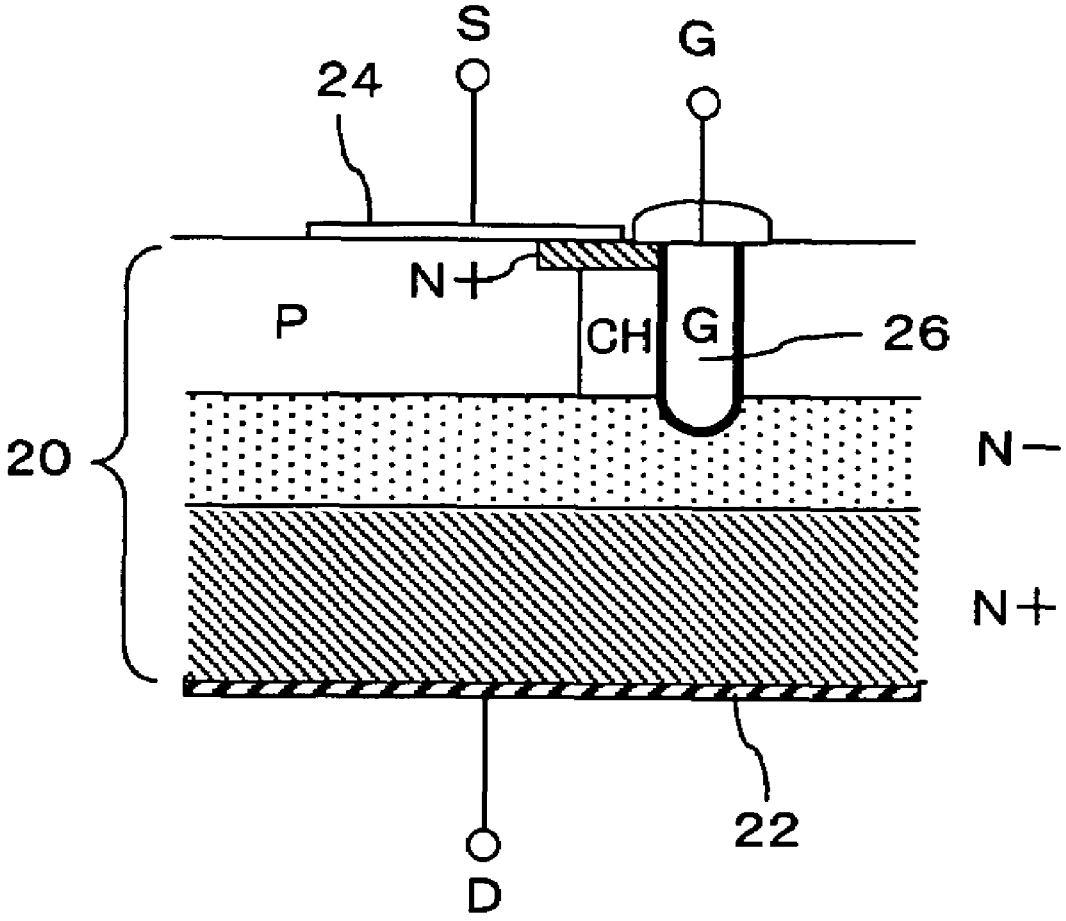
FIG. 2 is a diagram showing an example configuration of an N channel transistor.
Figure 3:
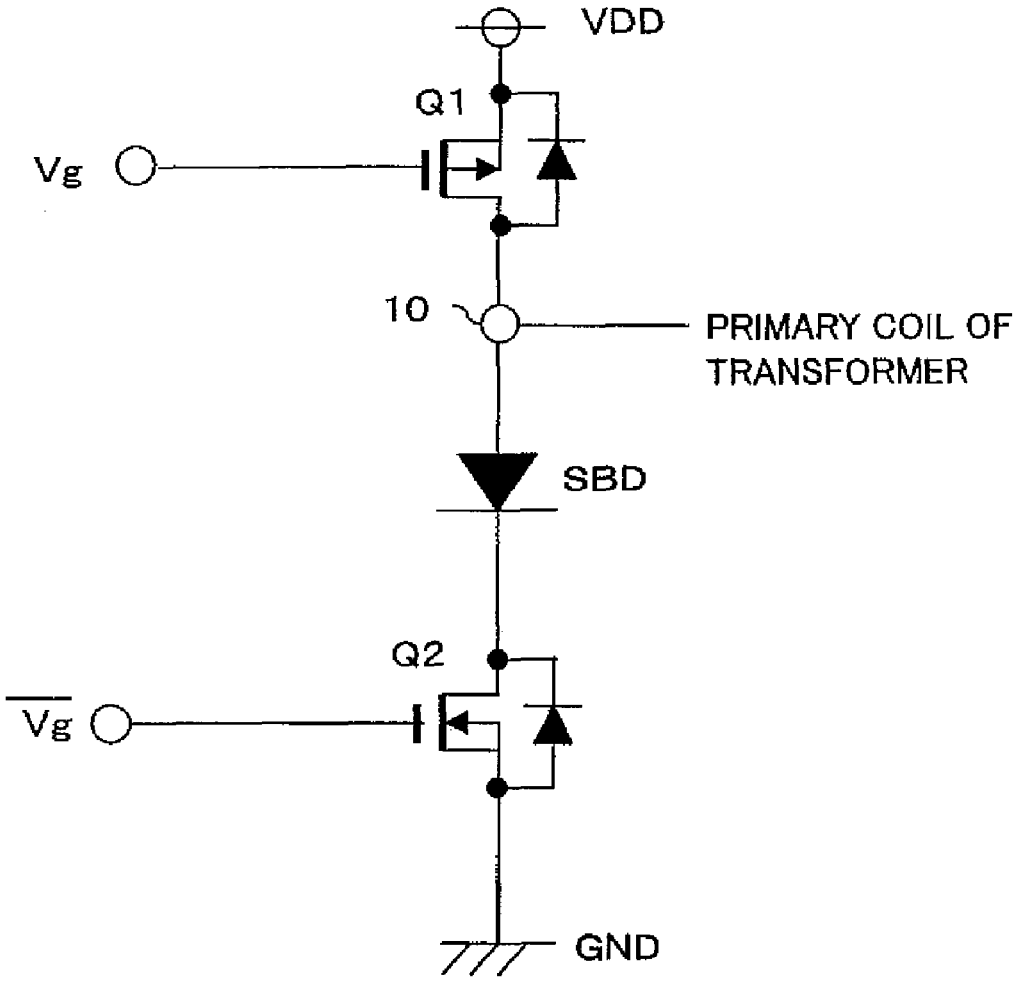
Fig. 3 PRIOR ART
FIG. 3 is a diagram showing the configuration of a conventional example.

FIG. 2 shows the configuration of a transistor suitably used as the first and second N channel transistors Q10 and Q12. A drain electrode 22 is formed on a back surface of a semiconductor substrate 20. An N+ area is formed at the bottom of the semiconductor substrate 20. An N− area and a P area are formed on the N+ area in this order.

An N+ source area is formed on a front surface of the P area. A source electrode 24 is formed in the N+ source area. Further, a trench type gate electrode 26 is formed in an area two-dimensionally adjacent to the source area so as to penetratingly extend from a top surface of the P area to the N− area. A gate insulating film is formed on a front surface of a trench portion of the gate electrode 26. With this configuration, a predetermined voltage is applied to between the source and drain, and a positive voltage is applied to the gate electrode. Then, a reverse area is formed in a part of the P area (in a channel area CH) which is close to the gate electrode. A current then flows between the source and the drain. With this configuration, the P area is maintained at the same potential as that of the source area to form a body diode between the source and drain.

Although the example used to illustrate the present embodiment utilizes an N channel transistor configured, for example, as described above, a similar body diode can be formed even if the transistor is not of the trench type. Accordingly, the N channel transistors Q10 and Q12 according to the present embodiment are not limited to the trench type.

What is claimed is:

1. A current control circuit comprising:

a current drawing terminal to which a primary coil of a transformer is connected;

a first N channel transistor having a source connected to the current drawing terminal and having a body diode that directs a current from the source to a drain; and a second N channel transistor having a drain connected to the drain of the first N channel transistor and a source connected to a ground, the second N channel transistor having a body diode that directs a current from the source to the drain, and wherein the first and second N channel transistors are turned on to direct a current from the current drawing terminal to the ground via the first and second N channel transistors, and the first and second N channel transistors are turned off to stop the current from the current drawing terminal and to allow the body diode of the first N channel transistor to inhibit a current flowing from the ground to the primary coil of the transformer.

2. The current control circuit according to claim 1, further comprising:

a resistor connected between a gate of the first N channel transistor and the ground;

a capacitor connected between the gate of the first N channel transistor and a gate of the second N channel transistor; and a diode that permits a current from the drain to gate of the first N channel transistor, and wherein an input signal is input to the gate of the second N channel transistor and is set to an H level to turn on the second N channel transistor, and the drain of the first N channel transistor is set at a ground potential to turn on the first N channel transistor to direct the current from the current drawing terminal to the ground via the first and second N channel transistors, a charge voltage at the capacitor being subsequently discharged via the resistor to turn off the first N channel transistor to stop the current from the current drawing terminal, the body diode of the first N channel transistor inhibiting the current flowing from the ground to the primary coil of the transformer, and the input signal is set to an L level to turn off the second N channel transistor, and the capacitor is charged with the current flowing from the current drawing terminal via the body diode of the first N channel transistor.

3. The current control circuit according to claim 1, wherein each of the first and second N channel transistors comprise:

a semiconductor substrate:

a drain electrode formed on a back surface of the semiconductor substrate;

an N area formed on the back surface of the semiconductor substrate;

a P area formed on a front surface of the semiconductor substrate;

a source electrode and a gate electrode formed on the front surface of the semiconductor substrate so as to be electrically separate from each other;

a trench type gate electrode area provided below the gate electrode of the semiconductor substrate so as to penetrate the P area; and a source area provided on a front surface of the P area of the semiconductor substrate and a part of which contacts with the source electrode and is located on a side of the gate electrode area, and wherein the P area sandwiched between the source area and the N area and located on the side of the gate electrode area functions as a channel area.

* * * * *